US005102744A

United States Patent [19]

Wirz et al.

[11] Patent Number: 5,102,744

[45] Date of Patent: Apr. 7, 1992

[54] METAL FOIL ELECTROFORMED WITH A MASTER PATTERN, THE MASTER PATTERN PER SE, AND METHOD OF MANUFACTURE

[75] Inventors: Arno Wirz, Bammental; Hans-Jürgen Beck, Heidelberg, both of Fed. Rep. of Germany

[73] Assignee: Heidelberger Druckmaschinen AG, Heidelberg, Fed. Rep. of Germany

[21] Appl. No.: 485,242

[22] Filed: Feb. 26, 1990

[30] Foreign Application Priority Data

Feb. 24, 1989 [DE] Fed. Rep. of Germany ..... 3905679

[51] Int. Cl.[5] ..... B41N 10/00; C25D 1/04; B41F 13/42

[52] U.S. Cl. ..... 428/600; 428/606; 428/687; 101/422; 205/69; 205/76

[58] Field of Search ..... 101/420, 422; 204/12, 204/6, 13, 4; 428/687, 606, 600, 607, 667

[56] References Cited

U.S. PATENT DOCUMENTS

| | | | |
|---|---|---|---|
| 1,789,273 | 1/1931 | Howe | 101/420 |
| 2,020,177 | 11/1935 | Grove | 101/420 |
| 2,555,319 | 6/1951 | Cross | 101/422 |
| 2,991,544 | 7/1961 | Gotsch et al. | 428/687 |
| 3,161,130 | 12/1964 | Vogel | 101/422 |
| 3,398,442 | 8/1968 | Palmer | 204/12 |
| 3,556,874 | 1/1971 | McClain | 428/687 |
| 3,649,474 | 3/1972 | Blakeslee et al. | 204/6 |
| 4,088,544 | 5/1978 | Hutkin | 204/12 |
| 4,327,135 | 4/1982 | Wirz et al. | 428/600 |
| 4,556,462 | 12/1985 | Sakurai et al. | 204/6 |
| 4,775,599 | 10/1988 | Matsuoka et al. | 428/600 |
| 4,797,327 | 1/1989 | Honda et al. | 428/687 |
| 4,980,241 | 12/1990 | Hoffmueller et al. | 428/687 |

FOREIGN PATENT DOCUMENTS

| | | | |
|---|---|---|---|
| 639956 | 12/1936 | Fed. Rep. of Germany | 101/420 |
| 1258873 | 1/1974 | Fed. Rep. of Germany . | |
| 2446188 | 4/1976 | Fed. Rep. of Germany . | |
| 2605330 | 8/1976 | Fed. Rep. of Germany . | |
| 2820549 | 1/1979 | Fed. Rep. of Germany . | |
| 136480 | 7/1979 | Fed. Rep. of Germany | 101/420 |
| 2605330 | 5/1986 | Fed. Rep. of Germany . | |
| 3537483 | 12/1986 | Fed. Rep. of Germany . | |
| 648239 | 3/1985 | Switzerland . | |
| 1515342 | 6/1978 | United Kingdom . | |
| 2081178A | 2/1982 | United Kingdom | 101/422 |

*Primary Examiner*—John Zimmerman
*Attorney, Agent, or Firm*—Herbert L. Lerner; Laurence A. Greenberg

[57] ABSTRACT

A metal foil made by electroforming from a master pattern with the interposition of a negative form, and serving as packing for sheet guiding cylinders and/or drums of rotary printing machines, including a substantially planar member having one flat face and an opposite face with a textured surface structure corresponding to an upper side of the master pattern, the upper side of the master patten having been roughened by a jet treatment and coated with a levelling galvano-layer in order to eliminate undercuts, the master pattern per se, and method of manufacture.

8 Claims, 3 Drawing Sheets

FIG. 1
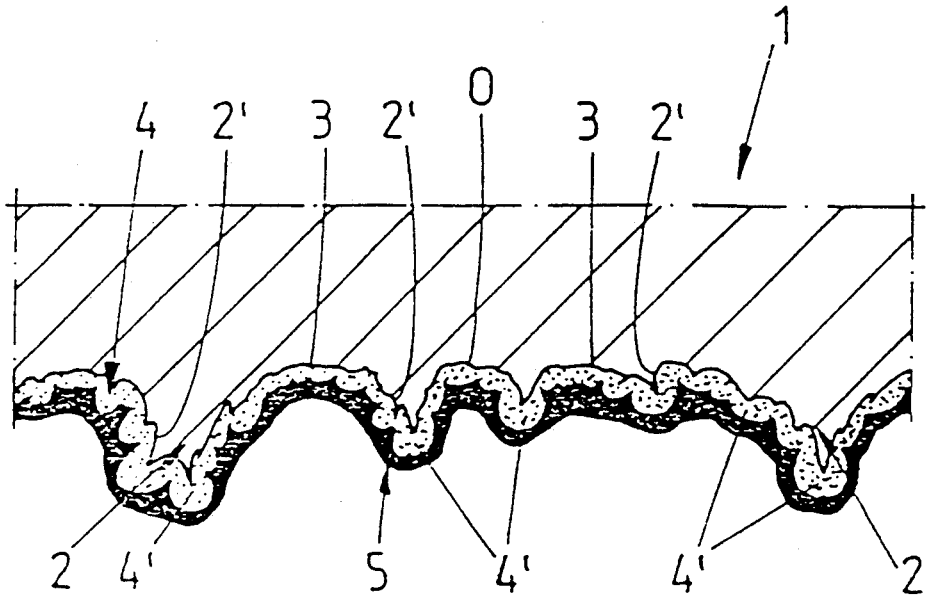
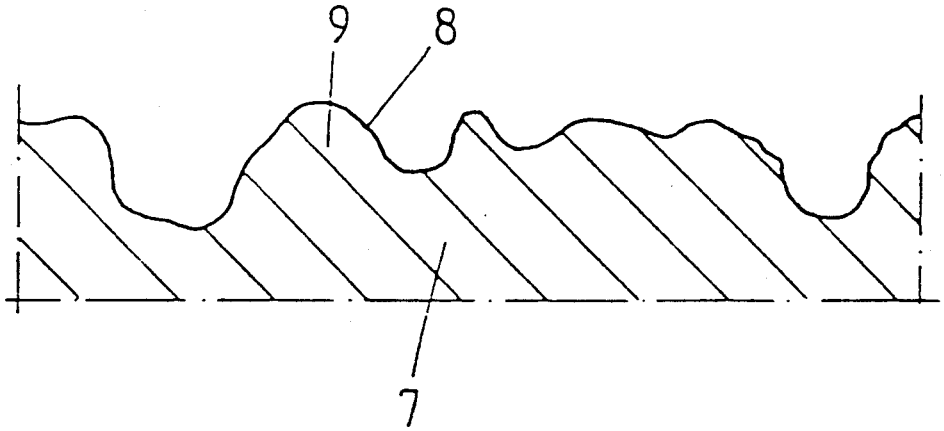
FIG. 2

METAL FOIL ELECTROFORMED WITH A MASTER PATTERN, THE MASTER PATTERN PER SE, AND METHOD OF MANUFACTURE

BACKGROUND OF THE INVENTION

1. Field of the Invention

The invention relates to a metal foil electroformed from a master pattern and, more particularly, a metal foil serving as packing for sheet-guiding cylinders and/or drums on rotary printing machines, the metal foil having one flat face, and an opposite face with a textured surface structure. The invention also relates to the master pattern and a method of forming the metal foil and the master pattern.

2. Description of the Related Art

Heretofore known metal foils of this general type, as described in German Published Prosecuted Application (DE-AS) 26 05 330, are preferably formed of solid nickel, and possess a surface structure or texture corresponding substantially to a glass beaded fabric which has also become known heretofore for the same purpose. This results from the fact that electroforming (previously known as galvanoplastic molding) of metal foils is effected from a negative pattern which, for its part, is molded from a positive master pattern made up of a carrier or support foil having a layer of rubber applied thereto, with glass balls embedded in the rubber and partially protruding from the surface thereof. An advantage of these known metal foils is that the surface structure or texture is largely reproducible. This is vital for speedy and efficient use in the printing process, for example, for the control-free exchange of a damaged metal foil for a new one. A disadvantage of these known metal foils, however, is that no optimal surface topography is available with respect to various operating requirements.

The same disadvantages are apparent in another heretofore known solution (European Patent 17 776), wherein a sheet-guiding foil, as packing for impression cylinders of rotary printing machines for perfector printing, is flat on one surface, and is provided with spherical calottes of equal height in a statistically uniform distribution, and wherein the foil is formed of a carrier or support layer and a covering layer, the carrier or support layer being formed of nickel or plastic material with a high modulus of elasticity, e.g. polyamide or PVC, a covering layer being applied in the form of a thin chromium layer to the surface on which the spherical calottes are formed so as to compensate for micro-roughness. This compensation for the micro-roughness does not change the contemplated, very even spherical calotte or shell topography of the surface.

With regard to reaching a compromise concerning roughness, German Patent 12 58 873 proposes surface structures or textures for an impression cylinder and for an aluminum foil assigned thereto, respectively, which is formed with a chromium surface having a roughness (RMS) of between 2 and 7.5 mu. By this means, two marginal conditions in the compromise should be optimally fulfilled, namely, that the roughness on the one hand, is sufficient to bring about an asserted given ink-repellant effect, for example to impede slurring or smearing of the rear side of the freshly-printed sheet during second-side or perfector printing, and, on the other hand, that the roughness is as low as possible, in order to ensure the optimal support or contact surface area for the bearing surface of the sheet. On the one hand, as has been found, this compromise is not optimally achieved. On the other hand, this solution has the disadvantage that it is not reproducible with regard to the surface structure or texture. Even if the dimensioning of the roughness (taken over the whole foil at the corresponding average) is reproduced with acceptable tolerance, the surface structure or texture of each foil as a whole again deviates very markedly from the next foil, and each cylinder surface deviates from the next cylinder surface, respectively. The reproducible jet treatment of such thin aluminum foils is also problematic, as is the stability of use thereof. All products previously known in this regard with jet-roughened surfaces accordingly present the same unique characteristics.

SUMMARY OF THE INVENTION

It is, accordingly, an object of the invention to provide a metal foil of this general type which, while offering optimal adaptation of the surface structure or texture to the functioning conditions of the foil, provides identical reproducibility of the foil.

With the foregoing and other objects in view, there is provided, in accordance with the invention, a metal foil made by electroforming from a master pattern wherein either the surface texture of the metal foil corresponds to an upper side of the master pattern which is roughened by jet treatment, and is coated with a leveling galvano-layer, e.g. a bright or burnished nickel layer, in order to eliminate undercuts, or the metal foil is molded or electroformed from an upper side of the master pattern which is roughened by jet treatment and coated with a leveling galvano-layer, e.g. a bright or burnished nickel layer, in order to eliminate undercuts.

This construction results in a metal foil serving as packing for sheet-guiding cylinders and/or drums on rotary printing machines and having a surface structure or texture basically representing the duplicate of a surface produced by jet treatment (and thereafter freed of undercuts), and is thereby, on the one hand, clearly capable of highest quality precise reproduction at all times and, on the other hand, provides optimal conditions with respect to the prevention of slurring or smearing. In this regard, it has been found that the structure of a jet-roughened and suitably leveled surface offers the most favorable compromise, both directly (as a positive profile) and also through its negative profile, especially with respect to the contact area, the washability of the metal foil, and the prevention of slurring or smearing. All of the foregoing, together, create optimal conditions of use. Essential to the invention is the discovery that this optimization is achieved if the roughness elevations of a surface (of the master pattern) created by jet treatment are leveled, and thereby freed of any undercuts whatsoever, so that the finished molded metal foil can then have no indentations which widen as they extend into the depth, nor any elevations having an overhang.

The jet treatment for roughening the upper side of the master pattern can be effected by conventional blasting or jet processes, e.g. by shot peening. The surface thus produced may be provided additionally with a chromium layer, also for purposes of stabilization and to extend its lifetime. Such a chromium layer applied to a surface topography produced by jet and then galvanically leveled improves the surface compensation even further because, for example, there are no electrolytically favored edges/points, and so forth, due to the absence of back tapers. metal foil of this type is also best suited to effect a very fine adaptation or accommodation to different thicknesses of paper on a cylinder, by suitable underlayment of the foil. As has been found, due to the special conditions with respect to the contact area portion of the overall surface, the appearance or shape of the contact area, the material, the distribution of the contact surfaces, the difference in heights and their distribution, the shape of the prominences and depressions, i.e., hills and valleys, and especially of their flanks or sides, a solution is arrived at which is superior in technological application both to the micro-smoothed spherical calottes or shells of uniform distribution and height, and also to the jet-roughened (and chrome-coated) cylinder surfaces (with back taper recesses or undercuts). By suitably dimensioning the bright or burnished nickel mass which is to be applied, another good possibility is provided for influencing the foregoing factors.

More specifically, there is provided, in accordance with the invention a metal foil made by electroforming from a master pattern with the interposition of a negative form, and serving as packing for sheet guiding cylinders and/or drums of rotary printing machines, which comprises a substantially planar member having one flat face and an opposite face with a textured surface structure corresponding to an upper side of the master pattern, the upper side of the master pattern having been roughened by a jet treatment and coated with a leveling galvano-layer in order to eliminate undercuts.

In accordance with another feature of the invention, the leveling galvano-layer is a burnished nickel layer.

In accordance with an additional aspect of the invention, there is provided, a metal foil manufactured by electroforming from a master pattern, and serving as packing for sheet-guiding cylinders and/or drums of rotary printing machines, comprising a substantially planar member having one face which is flat and an opposite face which is surface-textured, the metal foil being molded from an upper side of the master pattern which has been roughened by jet treatment, and coated with a leveling galvano-layer, in order to eliminate undercuts.

In accordance with an added feature of the invention, the metal foil is formed of nickel and, after it has been molded, the textured surface structure of the metal foil is coated with a thin chromium layer.

In accordance with another aspect of the invention, there is provided, a positive master pattern for electroforming a metal foil made up of a support layer formed of nickel, and a covering layer, one face of the support layer being flat and an opposite face thereof being textured, the covering layer being formed of chromium, and covering the textured layer, which comprises a member having a face roughened by a blowing and jet process, respectively, said roughened face being coated with a leveling galvanic layer.

In accordance with an additional feature of the invention, the roughness produced by jet is between 30 and 50 Rz, and the face has a contact surface which, after application of the chromium layer and the bright nickel layer, has increased from about 15% at a depth of 10 mu to about 85% at a depth of 30 mu.

In accordance with a further aspect of the invention, there is provided a method of electroforming a metal foil from a master pattern, the metal foil serving as a packing for sheet guiding cylinders and/or drums of rotary printing machines, which includes roughening an upper side of the master pattern with a jet treatment and coating the upper side of the master pattern with a leveling galvano-layer in order to eliminate undercuts, then forming the metal foil with one flat face, and molding from the upper side of the master pattern an opposite face of the metal foil having a textured surface structure corresponding to that of the upper side of the master pattern.

In accordance with an added mode of the invention, the method includes interposing a negative form between the master pattern and the metal foil.

In accordance with another mode of the method of the invention, the leveling galvano-layer is a burnished nickel layer.

In accordance with a concomitant mode of the invention, the method includes coating the textured surface structure of the metal foil with a thin chromium layer.

Other features which are considered as characteristic for the invention are set forth in the appended claims.

Although the invention is illustrated and described herein as embodied in a metal foil electroformed with a master pattern, the master pattern per se, and method of manufacture, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF DRAWING

FIG. 1 is a fragmentary sectional view of the upper side of a master pattern from which a metal foil is formed as packing for sheet-guiding cylinders and/or drums on rotary printing machines;

FIG. 2 is a sectional view of a metal foil formed from the master pattern of FIG. 1;

DESCRIPTION OF THE PREFERRED EMBODIMENTS

Figure 3:
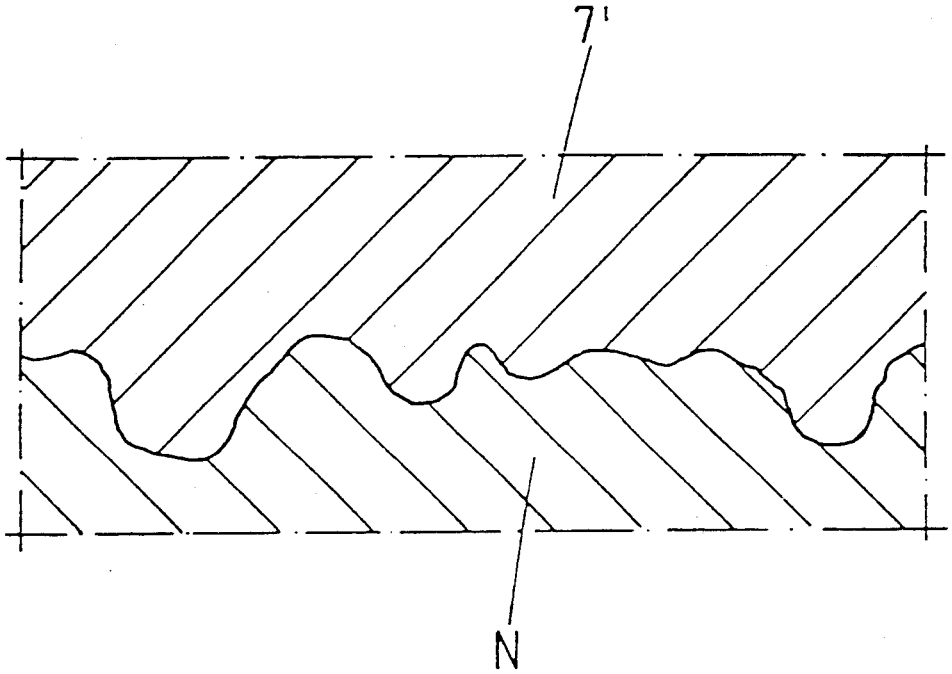
FIG. 3 is a view like those of FIGS. 1 and 2 of the metal foil and a negative form for producing the metal foil.

Referring now to the drawing and, first, particularly to FIG. 1 thereof, there is shown therein, in sectional view, the upper side of a master pattern. This master pattern may, as a whole, have the shape of a cylinder, preferably formed of aluminum. It has an upper side 0 with a textured surface, the surface texturing being achieved by means of jet treatment, e.g. by shot peening, so that elevations 2 with undercuts or back tapers 2' and depressions 3 are formed. This textured surface is then galvanically coated with a chromium layer 4. As is apparent, the chromium layer 4 modifies the topography of the surface at the locations 4', that is, in front of exposed points of the elevations 2, e.g., at 4'', however, more so that the undercuts or back tapers 2 are enlarged. It is essential to the invention to have discovered that, because of such undercuts or back tapers 2', the jet-roughened surface appears in many respects to be less advantageous than, for example, a spherical-segment or calotte-shell topography. If the back tapers or undercuts 2' are eliminated, the jet-roughened surface, as has been found, is superior to all other surface structures. The chromium layer 4 is subsequently covered with a bright or burnished nickel layer 5. This completely levels or evens out the surface and, especially the flanks or sides of the elevations/depressions coated with the chromium layer, so that no undercuts or back tapers of any kind are present, whether they are back tapers or undercuts 2' from the jet treatment or those resulting from the galvanic application of the chromium layer 4. This upper side of the master pattern 1, produced by means of the leveling galvano-layer 5 (bright or burnished nickel layer), is then used for galvanoplastically or electroformingly molding the metal foil 7 in accordance with FIG. 2. The material thereof is preferably nickel. The side thereof which comes into contact with the sheet has a negative profile of the texture profile created by jet treatment, but without any overhangs or projections on the flanks or sides 8 of the elevations 9 thereof, which not only optimizes the printing-function technology, but also improves it with regard to cleaning technology, and avoids pockets or recesses for long-term corrosion. This metal foil 7 can either be the metal foil per se according to the invention, or a negative form N for producing a metal foil 7', shown in FIG. 3. Both in the case of the metal foil 7, as well as the metal foil 7', they are always homogenous duplicates, from the standpoint of the material thereof, of the corresponding master pattern surface, it being very important with regard to the positive version according to 7', that the bearing or contact areas (peaks) of varying height are relatively widely distributed, and the location and construction thereof can be influenced, so that factors of material homogeneity and absence of any back tapers or undercuts therein contribute in common to optimizing the use thereof.

Figure 4:
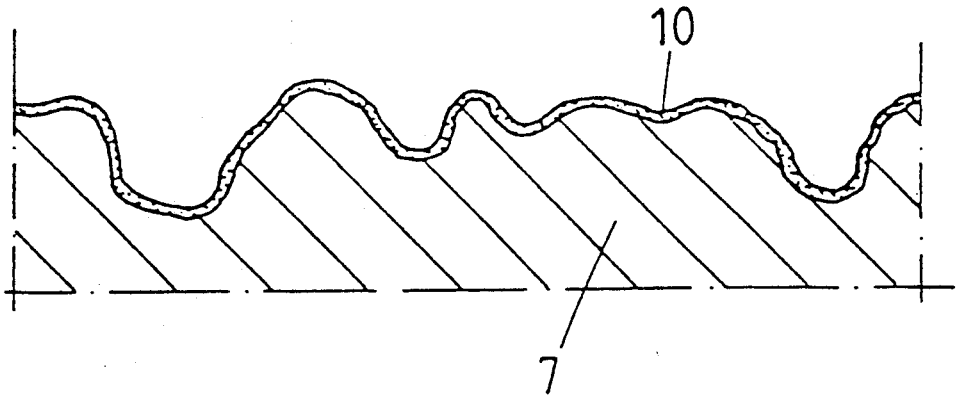
FIG. 4 is a view like that of FIG. 2 of a metal foil coated with a chromium layer.
Figure 5:
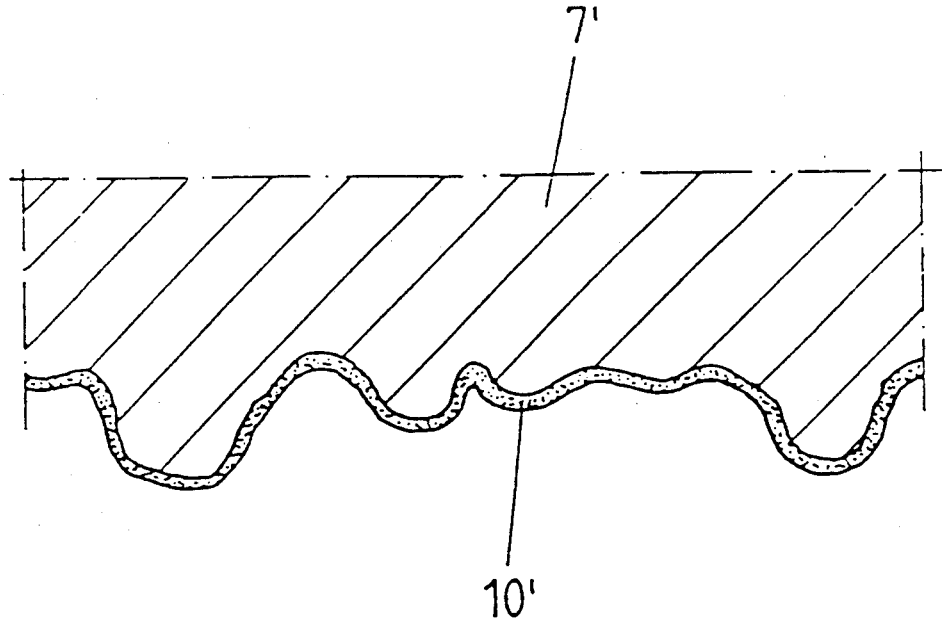
FIG. 5 is a view like that of FIG. 3 of the positive profile of the master pattern having a thin chromium layer.

As can be seen from FIG. 4, after the electroforming or galvanic molding, the metal foil 7 can be coated with a thin chromium layer 10, which not only optimizes the stability, but also the slur or smear prevention behavior thereof. As shown in FIG. 5, the foregoing also applies to the metal foil 7', with regard to which the positive profile of the master pattern is thus fitted with this thin chromium layer 10'.

At all times, a roughness structure or texture is present on which the surface structure, including the flanks or sides of the roughness elevations created by jet treatment, is leveled. The roughness is between about 30 to 60 Rz; the support component or contact surface TP is as follows, at the indicated individual depths:

TP at a depth of 10.0 mu=15%

TP at a depth of 20.0 mu=50%

TP at a depth of 30.0 mu=84%

The thickness of the chromium layer 4 is preferably about 40 to 50 mu, and that of the bright or burnished nickel layer about 10 to 15 mu. The thickness of the chromium layers 10 and 10', respectively, is about 10 mu.

We claim:

1. A metal foil made by electroforming from a master pattern with the interposition of a negative form, and serving as packing for sheet guiding cylinders and/or drums of rotary printing machines, comprising a substantially planar member having one flat face and an opposite face with a textured surface structure corresponding to an upper side of the master pattern, the upper side of the master pattern having been roughened by a jet treatment and coated with a leveling galvano-layer in order to eliminate undercuts, said electroformed substantially planar member being formed of nickel, and said face thereof having said textured surface structure being coated with a thin chromium layer.

2. A metal foil manufactured by electroforming from a master pattern, and serving as packing for sheet-guiding cylinders and/or drums of rotary printing machines, comprising a substantially planar member having one face which is flat and an opposite face which is surface-textured, the metal foil being molded from a side of the master pattern which has been roughened by jet treatment, and coated with a leveling galvano-layer in order to eliminate undercuts, said electroformed substantially planar member being formed of nickel, and said face thereof having said textured surface structure being coated with a thin chromium layer.

3. A positive master pattern for electroforming a metal foil made up of a support layer formed of nickel, and a covering layer, one face of the support layer being flat and an opposite face thereof being textured, the covering layer being formed of chromium, and covering the textured layer, comprising a member having a face roughened by a blowing and jet process, respectively, said roughened face being coated with a leveling galvano-layer.

4. Metal foil according to claim 3, wherein the leveling galvano-layer is a burnished nickel layer.

5. Positive master pattern according to claim 3, wherein said roughness produced by said jet is between 30 and 50 Rz, and said face has a contact surface which, after application of the chromium layer and the nickel layer, has increased from about 15% at a depth of 10 mu to about 85% at a depth of 30 mu.

6. Method of electroforming a metal foil from a master pattern, the metal foil serving as a packing for sheet guiding cylinders and/or drums of rotary printing machines, which comprises roughening an upper side of the master pattern with a jet treatment and coating the upper side of the master pattern with a leveling galvano-layer in order to eliminate undercuts, then forming a metal foil layer with one flat face, and electroforming from the upper side of the master pattern an opposite face of the metal foil layer having a textured surface structure corresponding to that of the upper side of the master pattern, and coating the textured surface structure of the metal foil layer with a thin chromium layer.

7. Method according to claim 6, which includes interposing a negative form between the master pattern and the metal foil.

8. Method according to claim 6, wherein the leveling galvano-layer is a burnished nickel layer.

* * * * *